United States Patent [19]

Matzke et al.

[11] Patent Number: 4,909,900

[45] Date of Patent: Mar. 20, 1990

[54] METHOD FOR HIGH TEMPERATURE, HIGH CONSISTENCY QUICK BLEACHING OF RAW PAPER PULP

[75] Inventors: Wolfgang Matzke, Berg; Harald Selder, Schlier, both of Fed. Rep. of Germany

[73] Assignee: Sulzer-Escher Wyss GmbH, Ravensburg, Fed. Rep. of Germany

[21] Appl. No.: 370,878

[22] Filed: Jun. 23, 1989

Related U.S. Application Data

[63] Continuation-in-part of Ser. No. 133,067, Oct. 30, 1987.

[30] Foreign Application Priority Data

Mar. 4, 1986 [CH] Switzerland ..... 0867/86
Feb. 21, 1987 [CH] Switzerland ..... PCT/EP87/00097

[51] Int. Cl.[4] ..... D21B 1/16; D21B 1/32; D21C 9/10; D21C 9/18

[52] U.S. Cl. ..... 162/4; 162/6; 162/7; 162/26; 162/56; 162/57

[58] Field of Search ..... 162/25, 26, 24, 57, 162/4, 6; 168/56, 7, 18

[56] References Cited

U.S. PATENT DOCUMENTS 3,467,574 9/1969 West ..... 162/24
4,339,206 7/1982 Ahs ..... 162/57
4,381,969 5/1983 Cuester et al. ..... 162/6
4,390,395 6/1983 Cuester et al. ..... 162/6

FOREIGN PATENT DOCUMENTS 1102604 6/1981 Canada ..... 162/57
1239047 10/1959 France .

*Primary Examiner*—Steve Alvo
*Attorney, Agent, or Firm*—Werner W. Kleeman

[57] ABSTRACT

The bleaching chemicals are added to the pulp immediately after heating of the raw pulp thickened to more than 20% by weight and immediately prior to a dispersing process. This is carried out in a high-speed, high-efficiency disperser, where the heated, thickened pulp is forced through a plurality of narrow slits in a disperser lining and is exposed to strong shearing, impact and kneading stresses. In this way, the dispersing process is reduced to a time period less than 3 seconds, preferably about 1 second or less. As a result, the total time required for reductive bleaching is reduced to less than 15 seconds and no further measures are required for displacing and excluding air from the system. The method can also be advantageously used with oxidative bleaching at reduced reaction time requirements. A high dispersing temperature in the region of 40° C. to 110° C., preferably about 95° C. is possible and there are essentially simultaneously carried out the bleaching and dispersing actions without the need for separate dispersing stages and large reaction towers and pumps.

15 Claims, 1 Drawing Sheet

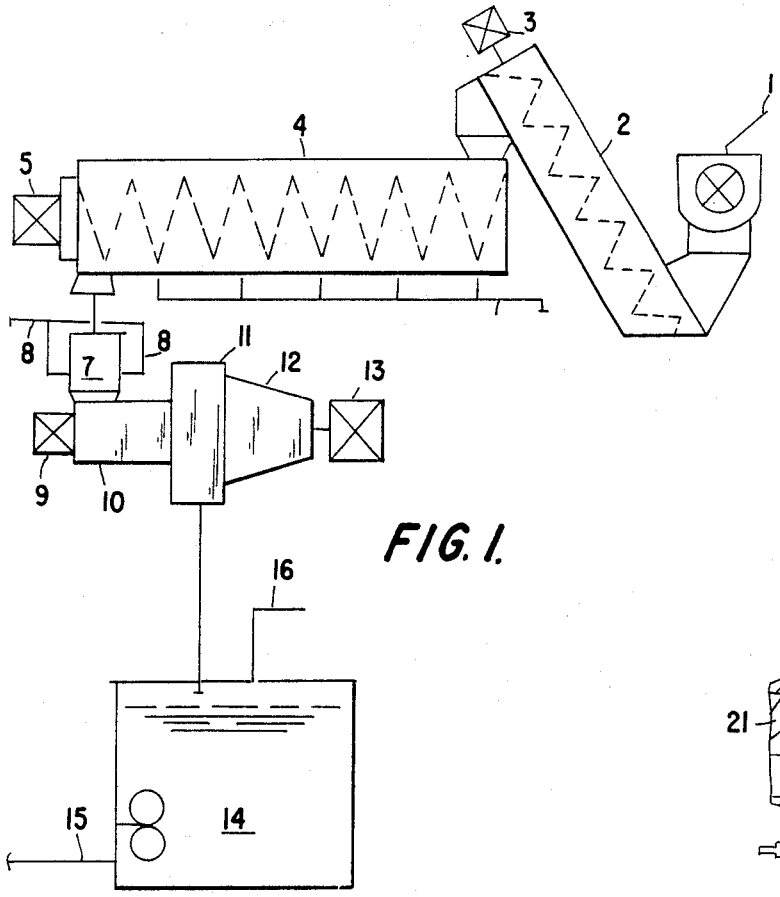
FIG. 1.
FIG. 2.
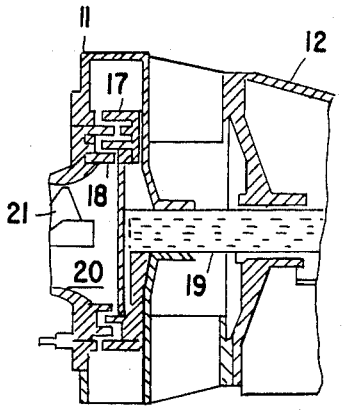
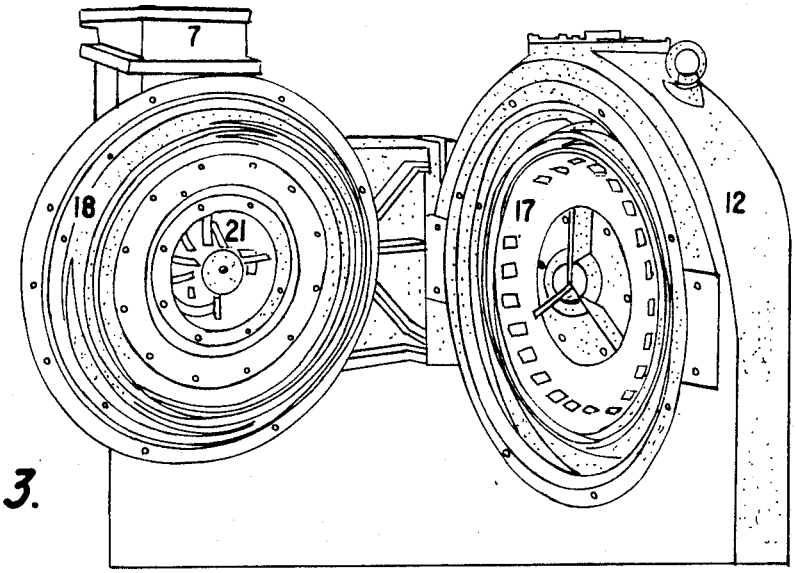
FIG. 3.

METHOD FOR HIGH TEMPERATURE, HIGH CONSISTENCY QUICK BLEACHING OF RAW PAPER PULP

CROSS-REFERENCE TO RELATED APPLICATION

This application is a continuation-in-part of the commonly assigned, copending U.S. application Ser. No. 07/133,067, filed Oct. 30, 1987, entitled "High Temperature, High Consistency Quick Bleaching".

BACKGROUND OF THE INVENTION

The present invention relates to a new and improved method of bleaching raw pulp used for manufacturing paper.

In its more particular aspects the present invention specifically relates to a new and improved method of bleaching raw pulp or fiber stock suspension prepared from waste paper and used for manufacturing paper. Such method may encompass oxidative, for example, peroxide bleaching as well as reductive bleaching using, for example, dithionite as the bleaching agent.

Both of the aforementioned bleaching methods at present usually constitute long-lasting, costly processes in terms of thermal energy. For carrying out such conventional processes, it is necessary to construct expensive structures such as, for instance, high bleaching towers to serve as reaction vessels, because the bleaching process requires a reaction time in the range of one to two hours.

According to one known method presently in use, dithionite is utilized as the reductive bleaching agent. A low-density pulp suspension having a consistency of 5% by weight is heated to 60° C. and 1 to 2% of dithionite is admixed to this material in a double shaft mixer. This mixture is transferred into a bleaching tower through which the mixture is upwardly passed during more than 60 minutes for bleaching purposes.

Another known method using dithionite as the bleaching agent is the so-called MC method, i.e. medium consistency method which operates at a pulp or fiber consistency of 15% by weight. Here again, 1 to 2% of dithionite is admixed to the material. The mixer is a mixer pump, the so-called MC pump, which rapidly and satisfactorily admixes the bleaching agent. However, when using this method, air venting must be ensured and the MC pump must be set up such that the air is vented during the mixing process. The reductive bleaching process must be carried out in the absence of air because the bleaching agent is decomposed in the presence of oxygen. The material mixed with the bleaching agent has a temperature of approximately 60° C. and, also in the process, the bleaching duration is approximately 60 minutes. Due to the higher consistency, a somewhat smaller bleaching tower can be used as compared to the aforementioned method utilizing low-density pulp.

With regard to oxidative bleaching, for example, by adding peroxide, such method has already been carried out at consistencies in the range of 15 to 30% pulp. The chemicals were admixed to the pulp in a low-speed disperser.

Reductive dithionite bleaching with pulp consistencies above 15% seems not to have been realized in practice. U.S. Pat. No. 2,963,395 proposes using pulp consistencies in the range of 20 to 50% and temperatures in the range of 38° C. to 110° C. for dithionite bleaching.

However, the air must be removed to a large extent and the bleaching process must be carried out in an air-tight reaction vessel.

Thus, it was known in the case of high consistency, high temperature reductive bleaching using dithionite as a bleaching agent that it was necessary to remove and keep away the air from the bleaching system. This has been found difficult despite the use of complicated means and the expenditure resulting therefrom exceeded the expected savings.

SUMMARY OF THE INVENTION

Therefore, with the foregoing in mind it is a primary object of the present invention to provide a new and improved method of bleaching raw pulp used for manufacturing paper and which method is not afflicted with the drawbacks and limitations of the prior art methods heretobefore discussed.

Another significant object of the present invention is directed to providing a new and improved method of bleaching raw pulp used for manufacturing paper and which method requires reduced reaction times in comparison to the known methods and permits operating at pulp consistencies above 15% by weight.

It is a further important object of the present invention to provide a new and improved method of bleaching raw pulp used for manufacturing paper and which method at least yields comparable results to known methods but is carried out under much more cost-favorable conditions.

Now in order to implement these and still further objects of the invention, which will become more readily apparent as the description proceeds, the pulp processing method of the present development, among other things, is manifested by the features that, the bleaching agent is added to the pulp immediately following heating of the thickened raw pulp and immediately prior to a dispersing step which is carried out in a high-speed, high-efficiency disperser in less than three seconds and at a temperature in the range of 40° C. to 110° C.

It has proved to be particularly advantageous to carry out the dispersing step in the high-speed, high-efficiency disperser in which the mixture is forced through a plurality of narrow slots in the disperser lining. The material is thereby simultaneously exposed to powerful shearing and impact stresses and the dispersing process i.e. the combined bleaching and dispersing process can be carried out in less than three seconds and may be effected even within one second.

When using reductive dithionite bleaching and working according to the inventive method, in a temperature range of 65° C. to 110° C. and in a pulp consistency range of 20% to 50% by weight, it has surprisingly been found that; due to the intense, extremely short dispersion of the reducing bleaching agent and the high reaction rate of the bleaching agent, special measures are no longer required for displacing or excluding the air or oxygen although such measures were hitherto considered to be indispensable. The high consistency of the pulp saves high thermal energy costs.

It is known from the literature that only a small activation energy is required in dithionite bleaching, so that the diffusion process is rate-determining for the bleaching reaction.

It has been recognized that due to the intense and extremely brief dispersion of the reducing bleaching agent after its addition to the heated and thickened raw pulp, the bleaching reaction on the fibers starts before the oxygen-sensitive bleaching agent has an opportunity to come into contact with air for a prejudicial period of time.

During passage of the heated and thickened raw pulp containing the added bleaching agent through the high-speed, high-efficiency disperser the pulp is forced through a plurality of narrow slots, and thus simultaneously exposed to powerful shearing and impact stresses resulting in an intense kneading operation. The active chemicals are thereby extremely rapidly brought into the immediate vicinity of the fibers, where simultaneously the diffusion of the chemicals into the interior of the fibers commences and takes place in a rapid manner.

Therefore, when carrying out the inventive method using the high-speed, high-efficiency disperser, two process functions are fulfilled in the same apparatus, namely (i) dispersing, i.e. mixing-in the bleaching chemicals and thereby bleaching and (ii) dispersing the pulp and thereby also rendering harmless impurities, which is necessary when processing waste paper.

Through such combined use of the high-speed, high-efficiency disperser, the hitherto maintained limit of pulp consistencies in the range of approximately 15% by weight to 18% by weight can be raised to the range of 20% by weight to 50% by weight, preferably 25% by weight to 31% by weight, which leads to a number of reaction-kinetic, energetic and combinatorial advantages.

The high pulp consistency requires a corresponding increase in the concentration of bleaching chemicals. In the presence of interfering constituents contained in the raw pulp, e.g. heavy metal ions which cause decomposition of the bleaching agent, an increase in the concentration of such interfering constituents must naturally be expected if the pulp consistency of the pulp to be processed is increased. This must be counteracted by suitable measures, for example, by complexing, i.e. the addition of complexing agents.

An advantageous embodiment of the inventive method operates at a temperature of substantially 95° C., which has been found sufficient for rendering harmless the aforementioned impurities or interfering constituents. Consequently, no additional heating of the pulp or fibrous material to such temperature is required. This must be viewed as a decisive advantage, because the thermal energy costs are significant, for instance, in the case of dithionite bleaching. It is obvious that the disperser temperature, which simultaneously constitutes the bleaching temperature, must not be so high as to cause excessive decomposition of the bleaching agent. This can be achieved by operating under unpressurized conditions and below 100° C.

As a further advantage of the inventive method there will be appreciated the economizing effect achieved in comparison with, for example, a large low density pulp or MC bleaching tower and the associated pump equipment. The inventive combination of dispersing and bleaching actions leads to the effect that one of the two apparatuses which otherwise would have been required for carrying out either one of these actions, can be dispensed with.

The inventive method renders fully effective the advantages of dithionite bleaching, which is distinguished by the following features:

Dithionite bleaching has a low activation energy, i.e. the reaction course is predominantly determined by the diffusion of the bleaching agent into the fibers and less or not at all by catalytic, dissociative and concentrative processes.

The reaction rate during dithionite bleaching is very high so that, for instance, 80% to 90% of the bleaching effect can be obtained in an effective bleaching time of 1 minute or less. The reaction is practically completed after 5 minutes. Thus, in place of a large bleaching tower for a 60 minute dwell time, a substantially smaller buffer container can be used due to the high reaction rate. This buffer container only must be dimensioned for a maximum dwell time of 15 minutes. Due to the rapid bleaching agent dispersion within a time period of approximately 1 second or less and due to the short and immediately starting bleaching process, no measures are required for displacing or excluding the air, as was previously necessary. Thus, the inventive reducing bleaching process can be performed even without the exclusion of air. There is no significant decomposition of the bleaching agent, so that the attainable brightness gain for a given bleaching agent charge is only slightly below or equal to that of the complicated and expensive, conventional bleaching method.

Through the inventive combination of dispersing and bleaching actions, there is no need for a separate bleaching stage, because the bleaching action takes place simultaneously with the dispersing step when carrying out the inventive method.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various Figures of the drawings there have been generally used the same reference characters to denote the same or analogous components and wherein:

FIG. 1 diagrammatically shows an installation for carrying out an exemplary embodiment of the inventive method;

FIG. 2 is a partial longitudinal section through a disperser in the installation shown in FIG. 1; and FIG. 3 is a photograph showing the disperser illustrated in FIG. 2 in an opened condition.

DETAILED DESCRIPTION OF THE PREFERRED EMBODIMENTS

Describing now the drawings, it is to be understood that only enough of the construction of the bleaching installation has been shown as needed for those skilled in the art to readily understand the underlying principles and concepts of the present development, while simplifying the showing of the drawings. Turning attention now specifically to FIG. 1 of the drawings, the diagrammatically illustrated installation shown therein by way of example and not limitation will be seen to contain a macerating screw apparatus 2 with a macerating screw driven by a drive motor 3. Raw pulp or fiber stock suspension 1 which may be prepared, for example, from waste paper and is intended for manufacturing paper, is passed into such macerating screw apparatus 2. Thereafter, the thus obtained macerated raw pulp is transferred into a heating apparatus 4 containing a screw driven by means of a drive motor 5 and heated by means of a steam conduit or line 6. Therein, the macerated pulp is heated to a temperature in the range of 40° C. to 110° C., for example, approximately 95° C. The thus obtained heated raw pulp is thickened to a consistency in the range of 20% by weight to 50% by weight, for instance 25% by weight to 31% by weight. Immediately after leaving the heating apparatus 4, the thus obtained heated and thickened raw pulp drops into a feed shaft 7 leading to a high-speed, high-efficiency disperser 11. The bleaching agents or chemicals are infed through a conduit or line 8 which opens into the feed shaft 7 and thus the bleaching agent is already added to the heated and thickened raw pulp in this feed shaft 7.

The mixing process then starts in the immediate vicinity of a conveying screw 21, which is housed in a casing 10 of the high-speed, high-efficiency disperser 11 and is driven by a drive motor 9. This conveying screw 21 mixes the material, i.e. the heated and thickened raw pulp containing the bleaching agent and conveys the mixture into the disperser chamber 20. Therein the mixture is hurled radially outwards and enters the teeth of the stator 18 or rotor 17 of the high-speed, high-efficiency disperser 11. The mixture is thus subjected to a combined bleaching and dispersing process which takes place in less than 3 seconds, preferably within 1 second. The mixture is forced through the chamber 20 and the teeth or toothing of the rotor 17 and the stator 18 under the action of the conveying screw 21. During passage through slots between such teeth, the mixture is exposed to powerful shearing, impact and kneading actions. The slots between the teeth or toothing are clearly visible in FIG. 3. During this passage through the high-speed, high-efficiency disperser 11 there is not only dispersed the bleaching agent in the heated and thickened raw pulp whereby the bleaching process is started and proceeds to a substantial portion of the total bleaching, but there is also effected the dispersing step during which contaminants or impurities, e.g. latex adhesives are rendered ineffective or harmless.

The known arrangement of the stator 18 and the rotor 17, as well as the teeth or toothing thereof can be particularly clearly seen in FIGS. 2 and 3 wherein also part of the conveying screw 21 is visible. The rotor 17 is carried and driven by means of a shaft 19 which is journalled in a casing 12 of the high-speed, high-efficiency disperser 11. This shaft 19 is driven by a drive motor 13. The rotor 17 has a relatively high rotational speed in the range of 1,000 to 3,600 revolutions per minute, depending upon the rotor diameter. This causes an extremely fast or flash passage of the heated and thickened raw pulp mixture containing the admixed bleaching agent through the high-speed, high-efficiency disperser 11 during the aforementioned time period of less than 3 seconds and, preferably, within 1 second.

The thus dispersed mixture is transferred from the high-speed, high-efficiency disperser 11 into a buffer tank or container 14 wherein the bleaching process is completed or ended. The bleached material is removed as finished pulp for further processing through a conduit or line 15. No special measures have to be taken to keep air away from the material. Thus, the tank 14 is also open to the atmosphere through a vent 16.

I. EXAMPLE 1

Reductive bleaching, namely dithionite bleaching

A mixture of mainly wood-free, partly coated and dyed waste paper was dissolved in a pilot installation at a 6% pulp consistency and at 45° C. without any addition of chemicals. Following slush or high-consistency stock cleaning with subsequent sorting, the pulp was washed by means of a Variosplit washer. The pulp consistency of the washed pulp was 7.6% and its brightness level $R_{457}$ was 54.2% MgO.

After diluting to 4.4%, the pulp was thickened to a pulp consistency in the range of 20% by weight to 50% by weight, namely 30.6% by weight in the present Example, in a strainer, particularly a wire press. The brightness level $R_{457}$ then was 54.7% MgO. After heating the thus thickened raw pulp in a heating screw to a temperature in the range of 65° C. to 110° C., namely 95° C. in the present Example, the heated and thickened raw pulp was passed through the high-speed, high-efficiency disperser 11 without adding bleaching chemicals. There was measured a brightness level $R_{457}$ of 52.6% MgO for the final product.

In a corresponding bleaching test the raw pulp was thickened and likewise heated to a temperature of 95° C. Thereafter, and without exclusion of oxygen, 1% sodium dithionite $Na_2S_2O_4$ and 0.25% of complexing agent DTPA were sprayed as a dilute solution with the aid of a nozzle onto the heated and thickened raw pulp in the feed shaft 7 of the high-speed, high-efficiency disperser 11. Directly thereafter, this heated and thickened raw pulp containing the aforenoted reducing bleaching agent and complexing agent, was fed into the conveyor screw 21 where the constituents were mixed without the exclusion of oxygen and fed without the exclusion of oxygen to the high-speed, high-efficiency disperser 11. After the material had passed through the high-speed, high-efficiency disperser 11 without the exclusion of the oxygen, a sample was taken; the brightness level $R_{457}$ was determined after different time periods. The following values were measured:

| | |
|---|---|
| At zero time | 61.3% MgO |
| After 5 minutes | 63.4% MgO |
| After 15 minutes | 63.5% MgO |
| After 30 minutes | 63.9% MgO |

It was therefore possible to raise the brightness level $R_{457}$ by more than 11 brightness points by carrying out the inventive combined dispersing and bleaching process using the high-speed, high-efficiency disperser 11.

II. EXAMPLE 2

Oxidative bleaching, namely peroxide bleaching

A mixture of wood-containing and wood-free waste paper was dissolved in a pulper at a 15% pulp consistency and at 50° C. with the addition of 0.2% of complexing agent DTPA, 0.4% of sodium hydroxide NaOH, 2% of water glass and 0.5% of hydrogen peroxide $H_2O_2$.

Following slush or high consistency stock cleaning and sorting, the pulp was washed on a Variosplit washer. The brightness level $R_{457}$ of the raw pulp was thereby raised from 60.5 to 64.3% MgO. The washed pulp had a pulp consistency of 8.5%.

This raw pulp was diluted to a 3.3% pulp consistency, a further 0.7% sodium hydroxide NaOH and 0.1% complexing agent DTPA were added. Subsequently the thus obtained raw pulp was thickened by means of a strainer or wire press to a pulp consistency in the range of 20% by weight to 50% by weight, namely 25.7% by weight in the present Example. Its brightness level $R_{457}$ then was 65.9% MgO. After passing through a heating screw during 5 minutes the pulp temperature was in the range of 40° C. to 110° C., namely 95° C. in the present Example. After passage through the high-speed, high-efficiency disperser 11 in the absence of oxidizing bleaching agents, the pulp consistency was 23% by weight and the brightness level $R_{457}$ was 64.1% MgO.

In an actual test with the addition of bleaching chemicals, 1% of hydrogen peroxide $H_2O_2$ was sprayed as a dilute solution with the aid of a nozzle onto the heated and thickened raw pulp in the feed shaft 7 upstream of the high-speed, high-efficiency disperser 11. After passing therethrough, samples were taken after different time periods and the brightness levels $R_{457}$ were measured. The following results were obtained:

| | |
|---|---|
| At zero time | 65.6% MgO |
| After 5 minutes | 65.9% MgO |
| After 15 minutes | 67.0% MgO |
| After 30 minutes | 68.2% MgO |
| After 60 minutes | 68.2% MgO |

Thus, although the raw pulp was already prebleached by the hydrogen peroxide added in the pulper, using the inventive method and the high-speed, high-efficiency disperser 11, it was possible to further increase the brightness level $R_{457}$ by 4.1 brightness points from 64.1 to 68.2% MgO.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of bleaching raw pulp used for manufacturing paper, comprising the steps of:

preparing a raw pulp having a predetermined pulp consistency;

heating said raw pulp to a temperature in the range of 40° C. to 110° C. and thereby thickening said raw pulp to a pulp consistency in the range of 20% to 50% by weight;

adding a preselected bleaching agent to said heated and thickened raw pulp;

mixing said heated and thickened raw pulp, which has the 20% to 50% consistency, and the added preselected bleaching agent;

feeding said mixture containing said heated and thickened raw pulp and said added preselected bleaching agent into a high-speed, high-efficiency disperser containing a labyrinth of a multiple number of narrow slots and thereby generating a forced flow through said labyrinth under the action of a centrifugal force;

passing said mixture containing said heated and thickened raw pulp and said added preselected bleaching agent at said temperature in the range of 40° C. to 110° C. through said labyrinth of the high-speed, high-efficiency disperser within a time period of less than 3 seconds and thereby conjointly dispersing said heated and thickened raw pulp and carrying out a substantial portion of the bleaching reaction; and during said step of conjointly bleaching and dispersing said mixture containing said heated and thickened raw pulp containing said added preselected bleaching agent, subjecting said mixture to a forced, multiply deflected flow through said labyrinth of the multiple number of narrow slots.

2. The method as defined in claim 1, wherein:

said step of mixing said heated and thickened raw pulp and said added preselected bleaching agent, includes using a conveyor screw for said mixing and for conveying said heated and thickened raw pulp mixed with said added preselected bleching agent to said high-speed, high-efficiency disperser.

3. The method as defined in claim 2, wherein:

said step of adding said bleaching agent entails adding said bleching agent to said heated and thickened raw pulp immediately upstream of said conveyor screw associated with said high-speed, high-efficiency disperser.

4. The method as defined in claim 1, further including the steps of:

selecting waste paper as raw material for preparing said raw pulp having said predetermined pulp consistency; and said step of heating and thickening said raw pulp entails heating said raw pulp to a temperature sufficient for rendering contaminants which are present in said raw pulp, ineffective with respect to a bleaching agent decomposing reaction of such contaminants.

5. The method as defined in claim 4, wherein:

said step of heating and thickening said raw pulp includes heating said raw pulp to a temperature of substantially 95° C.

6. The method as defined in claim 1, wherein:

during said step of heating and thickening said raw pulp, said raw pulp is thickened to a pulp consistency in the range of 25% to 31% by weight.

7. The method as defined in claim 1, wherein:

during said step of adding said preselected bleaching agent, a reducing bleaching agent is added to said heated and thickened raw pulp without the exclusion of oxygen; and during said step of conjointly bleaching and dispersing said heated and thickened raw pulp containing said added reducing bleaching agent, carrying out about 80% of the entire bleaching reaction without the exclusion of oxygen.

8. The method as defined in claim 1, further including the step of:

adding a predetermined proportion of said preselected bleaching agent during said step of preparing said raw pulp.

9. The method as defined in claim 8, wherein:

during said step of adding said preselected bleaching agent to said heated and thickened raw pulp, an oxidizing bleaching agent is added to said heated and thickened raw pulp.

10. The method as defined in claim 1, further including the steps of:

collecting said bleached and dispersed pulp in a buffer container; and storing said collected bleached and dispersed pulp for a time period sufficient for substantially completing the bleaching action.

11. The method as defined in claim 1, further including the step of:

adding a complexing agent for rendering ineffective contaminants which are contained in said raw pulp and otherwise would decompose said added preselected bleaching agent.

12. The method as defined in claim 11, wherein:

said step of adding said complexing agent includes adding said complexing agent during said step of adding said preselected bleaching agent.

13. The method as defined in claim 1, wherein:

during said step of adding said preselected bleaching agent to said heated and thickened raw pulp, an oxidizing bleaching agent is added to said heated and thickened raw pulp.

14. The method as defined in claim 1, wherein:

during said step of adding said preselected bleaching agent to said heated and thickened raw pulp, a reducing bleaching agent is added to said heated and thickened raw pulp.

15. A method of bleaching raw pulp used for manufacturing paper, comprising the steps of:

preparing a raw pulp having a predetermined pulp consistency;

heating said raw pulp to a temperature in the range of substantially 65° C. to 110° C. and thereby thickening said raw pulp to a pulp consistency in the range of 20% to 50% by weight;

adding a reducing bleaching agent to said heated and thickened raw pulp without the exclusion of oxygen;

mixing said heated and thickened raw pulp and the added reducing bleaching agent without the exclusion of oxygen;

feeding said mixture containing said heated and thickened raw pulp and said added reducing bleaching agent without the exclusion of oxygen into a high-speed, high-efficiency disperser containing a labyrinth of a multiple number of narrow slots and thereby generating a forced flow through said labyrinth under the action of a centrifugal force;

passing without exclusion of oxygen said mixture containing said heated and thickened raw pulp and said added reducing bleaching agent at a temperature in the range of substantially 65° C. to 110° C. through said high-speed, high-efficiency disperser within a time period of less than 3 seconds and thereby carrying out about 80% of the entire bleaching reaction without the exclusion of oxygen; and during said step of passing said mixture through said labyrinth of said high-speed, high-efficiency disperser, conjointly bleaching and dispersing said mixture containing said heated and thickened raw pulp and said added reducing bleaching agent by subjecting said mixture to a forced, multiply deflected flow through said labyrinth of the multiple number of narrow slots.

* * * * *